US005273008A

United States Patent [19]

Ditter

[11] Patent Number: 5,273,008

[45] Date of Patent: Dec. 28, 1993

[54] BALANCE VENT FOR AN INTERNALLY VENTED FLOAT BOWL CARBUETOR

[75] Inventor: Stephen D. Ditter, Fond du Lac, Wis.

[73] Assignee: Tecumseh Products Company, Tecumseh, Mich.

[21] Appl. No.: 930,899

[22] Filed: Aug. 17, 1992

[51] Int. Cl.[5] ..... F02M 1/16

[52] U.S. Cl. ..... 123/179.11; 261/72.1; 261/DIG. 8; 261/DIG. 67

[58] Field of Search ..... 123/179.11; 261/72.1, 261/DIG. 67, DIG. 8, 119.2

[56] References Cited

U.S. PATENT DOCUMENTS

| | | | |
|---|---|---|---|
| 1,586,683 | 6/1926 | Mock . | |
| 1,785,681 | 12/1930 | Goudard . | |
| 2,029,142 | 1/1936 | Wemhoner | 261/72.1 |
| 2,715,523 | 8/1955 | Moseley et al. | 261/DIG. 67 |
| 2,839,154 | 6/1958 | Sterner | 183/20 |
| 3,780,996 | 12/1973 | Nutten | 261/72.1 |
| 3,939,232 | 2/1976 | Higashigawa | 261/72.1 |
| 4,040,399 | 8/1977 | Meininger et al. | 261/DIG. 67 |
| 4,134,378 | 1/1979 | Kingsley | 261/DIG. 67 |
| 4,283,356 | 8/1981 | Arai et al. | 261/DIG. 67 |
| 4,323,522 | 4/1982 | Rasmussen | 261/72.1 |
| 4,360,481 | 11/1982 | Kaufman | 261/39 R |
| 4,377,146 | 3/1983 | Oniki et al. | 261/DIG. 67 |
| 4,387,062 | 6/1983 | Tanaka | 261/23 A |
| 4,499,032 | 2/1985 | Shibano | 261/72.1 |
| 4,556,031 | 12/1985 | Sugiura | 261/DIG. 67 |
| 4,679,534 | 7/1987 | Guntley et al. | 261/DIG. 8 |
| 4,738,232 | 4/1988 | Scott | 261/DIG. 8 |
| 4,836,506 | 6/1989 | Hundertmark | 261/23.2 |
| 4,926,808 | 5/1990 | Kandler | 123/187.5 R |
| 5,073,307 | 12/1991 | Langer et al. | 261/35 |

*Primary Examiner*—Tony M. Argenbright
*Assistant Examiner*—M. Macy
*Attorney, Agent, or Firm*—Baker & Daniels

[57] ABSTRACT

A balance vent for an internally vented float fuel bowl type carburetor in order to dampen pulse signal fluctuation to the internal vent that is created upon an excess vacuum buildup in the float bowl. The balance vent is a restricted passageway that communicates at one end with the internal vent circuitry and at its opposite end with the atmosphere external of the carburetor. The balance vent is sized so that the vacuum in the fuel bowl is bled off to the atmosphere only to a certain extent to permit an overall bowl vacuum to remain so that the characteristics of the internal bowl vent are maintained.

5 Claims, 3 Drawing Sheets

BALANCE VENT FOR AN INTERNALLY VENTED FLOAT BOWL CARBUETOR

BACKGROUND OF THE INVENTION

The present invention relates generally to carburetors for internal combustion engines, and more specifically to internally vented float bowl carburetors.

In a typical float bowl type carburetor, fuel flows from the reservoir in the float bowl through a fuel metering orifice into a fuel well from which the fuel is drawn up and mixed with air due to the pressure differential caused by the venturi region in the carburetor bore or throat. Since a continuous flow of fuel from the float bowl to the venturi must be provided in order to assure smooth engine operation, it is necessary to maintain a consistent fuel level in the float bowl. In order to obtain a consistent fuel level, a float control valve arrangement is provided such that as the fuel level in the float bowl is depleted through normal operation, the float control valve opens a conduit connected to a larger fuel storage tank. As fuel is replaced in the float bowl, an excess pressure is created above the fuel level. A proper fuel flow rate is facilitated by venting this excess pressure from the top of the float bowl to a constant pressure region. This venting may be to the atmosphere external of the carburetor (external venting) or to a region of relatively constant pressure close to atmospheric pressure within the carburetor bore (internal venting). Both types of venting arrangements are well known in the art.

Internally vented float bowl arrangements are advantageous to externally vented bowls in that air that is supplied to the vent has already passed through the carburetor air filter so that the likelihood of introducing additional contaminants into the carburetor is greatly reduced. In addition, in internally vented arrangements, as the air cleaner element becomes clogged and the pressure within the carburetor throat decreases, the pressure in the fuel bowl also decreases due to the passageway connecting the carburetor throat and bowl, thereby leaning out the fuel/air mixture to a level proportional to the level that existed when the air cleaner element was unobstructed.

In internally vented bowl arrangements, the venting function is influenced by conditions downstream of the air cleaner. For example, the internal bowl vent is subject to a relatively strong varied signal wave or pressure pulse that is produced upon the intake stroke of the engine. To a lesser extent, the pulse signal to the internal vent is affected by other engine factors such as valve and piston ring seals. In addition, pulse signal fluctuations to the internal vent are amplified in larger displacement engines, i.e. twenty cubic inches and larger, due to increased fuel demands. Pulse signal fluctuation to the internal vent is undesirable in that it results in an inconsistent flow of fuel from the float bowl to the venturi. As the vacuum in the fuel bowl increases, vent signal fluctuation is magnified.

It is desired to provide an internally vented carburetor arrangement that can be incorporated into current small engine designs, yet provides improved calibration consistency as well as maintains air cleaner blockage compensation.

SUMMARY OF THE INVENTION

The present invention overcomes the above problems by providing an internally vented carburetor float bowl arrangement, wherein an external vent passageway is provided in communication with the internal vent passageway to bleed off a portion of the float bowl vacuum to dampen the internal bowl vent signal thereby improving the functional consistency of the carburetor while retaining the functional characteristics of an internally vented bowl carburetor.

More particularly, the present invention, in one form thereof, provides a float bowl type carburetor, wherein the top of the float bowl is vented via an internal vent passageway to the air inlet passage of the carburetor. An external vent passageway, such as a calibrated orifice, is provided from the internal vent passageway to the atmosphere. The size of the orifice is such that a portion of the vent signal or vacuum is bled off to the atmosphere, thereby decreasing the vacuum in the float bowl. However, the orifice is sized to only bleed off bowl vacuum to a certain extent; therefore, an overall vacuum remains in the fuel bowl to permit the bowl to retain the favorable characteristics of a internally vented float bowl arrangement.

An advantage of the balanced venting arrangement of the present invention is that the external balance vent dampens the negative pressure signals to a level at which a constant, predictable bowl vacuum may be achieved.

Another advantage of the balanced venting arrangement of the present invention is that the carburetor retains the functional characteristic of leaning the fuel mixture in response to a decrease in air flow created by a restricted or partially blocked air cleaner element.

A further advantage of the balanced venting arrangement of the present invention is that the external balance vent is effective in operation, yet relatively simple in construction and economical to machine.

Still another advantage of the present invention is that the external vent passageway is configured to be resistant to dirt ingestion.

DESCRIPTION OF THE PREFERRED EMBODIMENT

Figure 1:
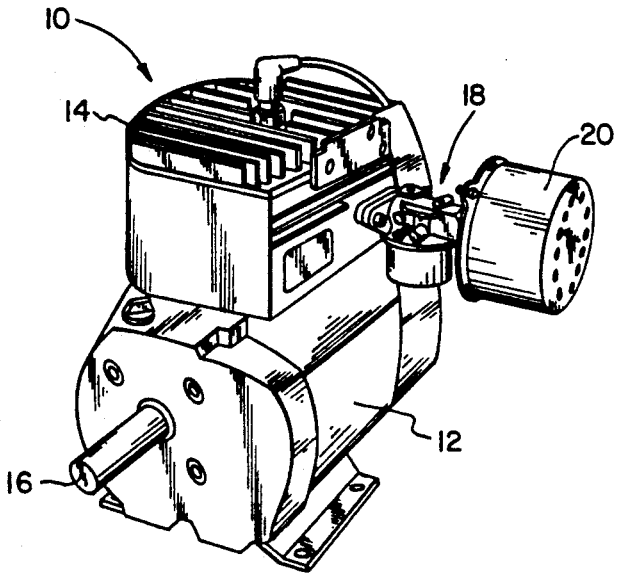
FIG. 1 is a perspective view of an internal combustion engine that includes a carburetor in accordance with the principles of the present invention.
Figure 2:
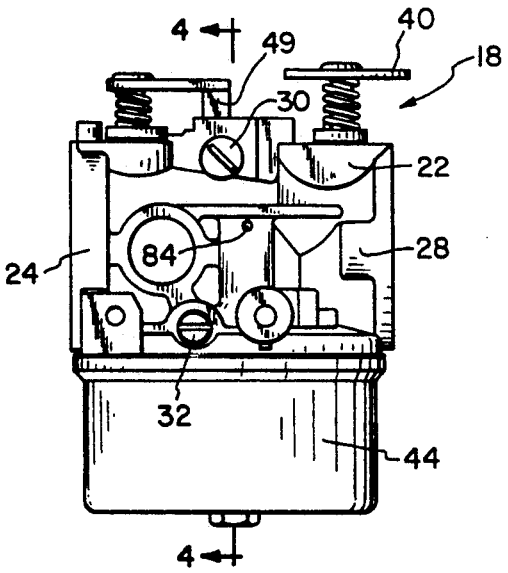
FIG. 2 is an enlarged side view of the carburetor of FIG. 1.
Figure 3:
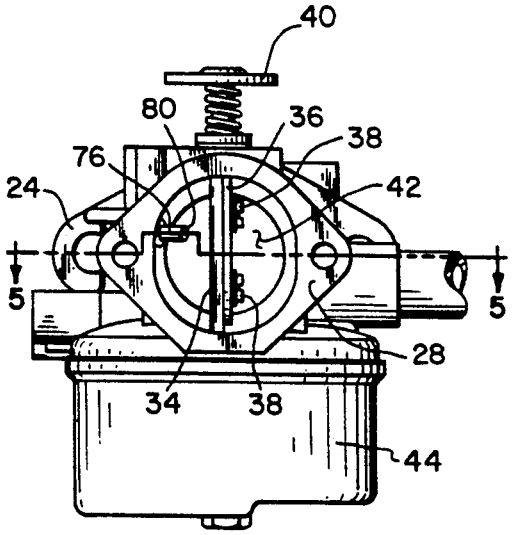
FIG. 3 is an end view of the carburetor of FIG. 2.

Referring now to the drawings, and in particular to FIG. 1, there is shown a conventional small air-cooled internal combustion engine 10 as might be used to power a lawn mower, for example. Engine 10 includes a crankcase 12 and a cylinder block 14, which may be cast with the crankcase as an integral unit or may be attached to the crankcase with bolts. Engine crankshaft 16 is keyed to the flywheel (not shown) which includes air circulating blades or vanes (not shown) for air cooling of the engine. Engine 10 further includes a carburetor 18, which may be formed of a suitable metal such as cast aluminum, and an exhaust system including a muffler 20. The remaining components of engine 10 (e.g., camshaft, piston, etc.) are well known and consequently are omitted for the sake of clarity in the following description.

Referring to FIGS. 2-5, carburetor 18 includes a carburetor body 22 having a flange 24 bolted either directly to the engine or to an intake manifold thereof. Carburetor body 22 includes a fuel inlet passage 25 for admitting fuel into the carburetor. Air is supplied to the carburetor through an air filter (not shown) which attaches to air cleaner mounting 28 on the air inlet side of the carburetor. Carburetor 18 includes a conventional idle speed adjusting screw 30 and an idle mixture adjustment screw 32. A choke plate 34 is installed on a shaft 36 via screw 38. Shaft 36 extends through the air inlet bore 37 of the carburetor. Plate 34 acts as a conventional butterfly valve that is moveable by actuating choke lever 40 between positions where bore 37 is nearly closed and where bore 37 is substantially unobstructed by the butterfly valve. A conventional throttle plate 42 is installed in outlet bore 41 of the carburetor. The throttle plate opening controls the amount of fuel-air mixture delivered to the cylinder. As with the choke plate, the throttle plate is installed on a shaft 43 via screw 47 and moveable by throttle lever 49.

Figure 4:
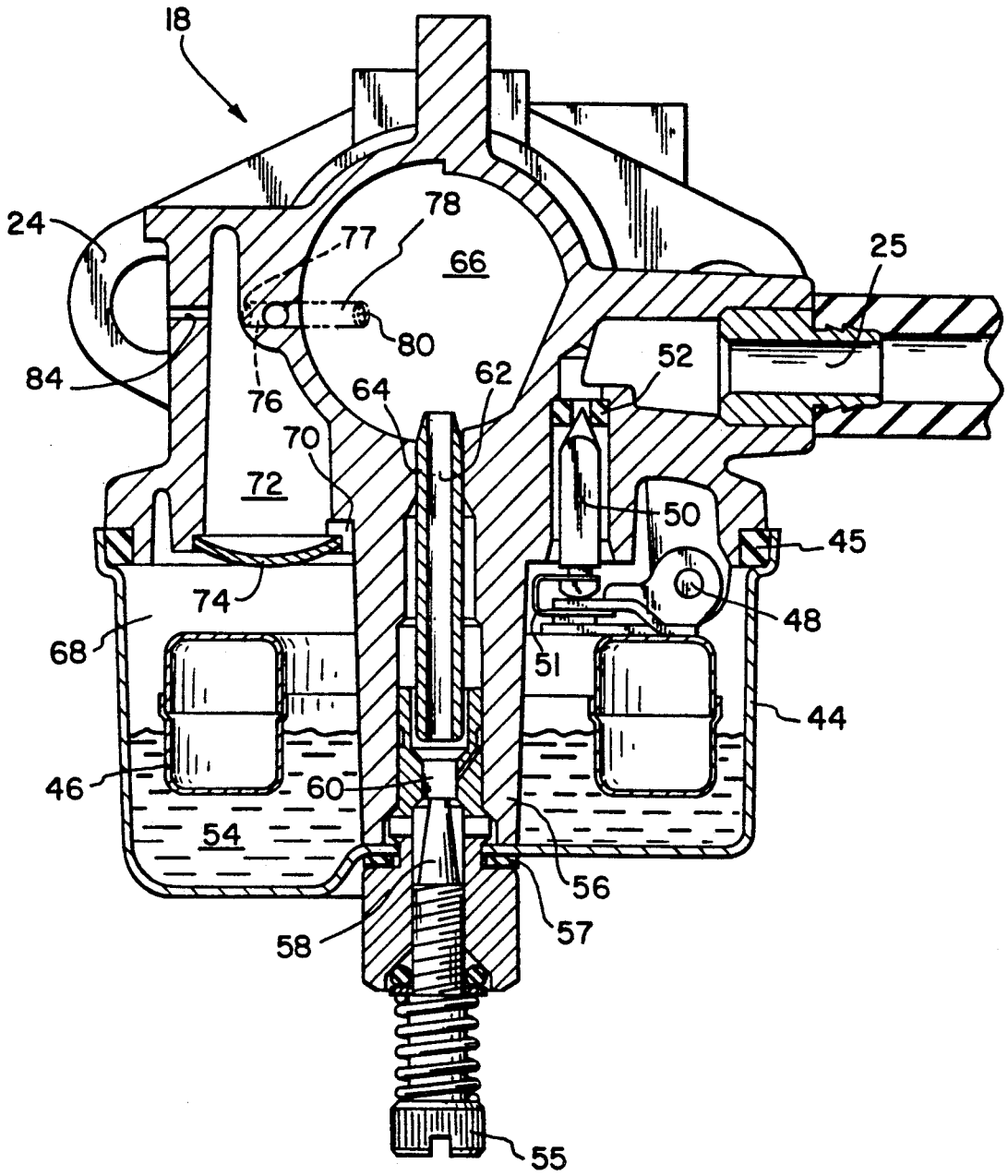
FIG. 4 is an enlarged sectional view of the carburetor of FIG. 2, taken along line 4—4 in FIG. 2.
Figure 5:
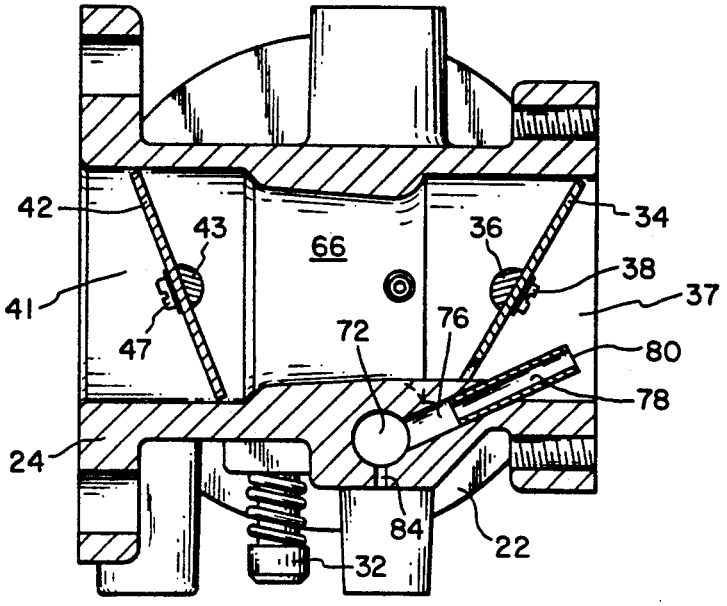
FIG. 5 is an enlarged fragmentary view of the carburetor of FIG. 3, taken along line 5—5 in FIG. 3.

Referring primarily to FIG. 4, carburetor 18 has a float regulated fuel supply chamber 44 of conventional construction. Float bowl 44 is sealingly attached to carburetor body 22 by means of an O-ring 45. Float 46, which is connected to an inlet needle 50 by means of an inlet needle clip 51, controls needle 50 with respect to seat 52 to open the valve defined by the needle and seat and allow fuel to enter float bowl 44 when the level of fuel 54 drops sufficiently to open the valve.

Fuel bowl 44 includes an adapter nut 55 which is sealed to fuel bowl 44 by means of a sealing washer 57. A series of fuel passages (not shown) in carburetor body 20 and adaptor nut 55 connect an annular insert 58 and fuel metering passage 60 with fuel 54. Metering passage 60 is also connected with a nozzle conduit 62 in nozzle 64 whereby fuel is drawn upwardly by means of the lower pressure existing in the fuel/air mixing passageway or venturi 66. The fuel is then mixed with air in venturi 66. This mixture is then drawn into engine 10 in conventional manner.

In order to vent excess pressure from headspace 68 above fuel 54 in bowl 44, a venting arrangement is provided. In particular, an internal venting arrangement is provided in order to minimize variations in fuel mixture richness resulting from variations in air intake path restrictions, such as a buildup of dirt in the air filter. An internal venting effect into venturi 66 is thus provided to act as a balancing or stabilizing factor to minimize these variations. Headspace 68 in bowl 44 is vented to the carburetor bore by an angled slot 70 formed in the side wall of cavity 72, which is closed at its lower end by a welch plug 74. A passage 76 extends from the upper end of cavity 72 at 77 and communicates a pilot tube 78 which has a free open end 80 positioned in the air inlet bore 37 closely adjacent the outlet end of the air filter and generally facing the carburetor air inlet.

In addition to the internal vent arrangement, an external venting arrangement is provided to improve the calibration consistency of the carburetor. In particular, a restricted passageway 84 communicates at one end with cavity 72 and communicates a its other end with the atmosphere external of the carburetor. Passageway 84 is designed to bleed off a given portion of the internal vent signal or vacuum in fuel bowl 44 to provide a lower bowl vacuum. For example, if fuel bowl 44 is designed to optimally operate at a vacuum of two inches of water, and the carburetor is operating at a bowl vacuum of three inches of water, passageway 84 will bleed off one inch of bowl vacuum to the atmosphere.

It is important to note that passageway 84 is sized so that the vacuum in fuel bowl 44 is bled off only to a certain extent, thereby permitting an overall bowl vacuum to remain so that the characteristics of an internal bowl vent are maintained. Generally, the amount of signal or vacuum sensed by the internal vent varies proportionately to the engine load. Thus, if the engine is operating at a partial load condition, the amount of bowl vacuum would be lower than it would be at a full load condition. Therefore, as bowl vacuum increases upon increased throttling, passageway 84 is designed to bleed off more signal to maintain a relatively constant bowl vacuum assuming a constant air cleaner blockage.

However, as is well known, air cleaner blockage increases as engine operation proceeds. For each incremental increase in air cleaner blockage, the desired bowl vacuum at which calibration consistency is achieved is also increased, although not necessarily in a linear relationship. Due to the calibrated orifice size of passageway 84, the portion of bowl vacuum bled off to the atmosphere as bowl vacuum increases due to increased cleaner blockage, at constant throttle, is an amount that achieves each desired bowl vacuum.

Preferably, passageway 84 is in the form of a calibrated orifice to achieve the precise tolerances necessary to provide the desired functionality. For example, in one type of engine tested, passageway 84 has a diameter of $0.062+0.002$ inch. Of course other vent passage sizes would be appropriate depending on the particular size of the individual engine and/or carburetor. Passageway 84 may be machined either as a straight passage as illustrated in the drawings or as a tortious path which may include a boss with a standpipe that angles downwardly to make the passageway more resistant to dirt ingestion. In addition, passageway 84 may be located at any position within the internal vent circuitry as long as passageway 84 communicates with the outside atmosphere. As an alternative to forming passageway 84 as a calibrated orifice, passageway 84 may be restricted by a jet insert or any other appropriate means.

Figure 6:
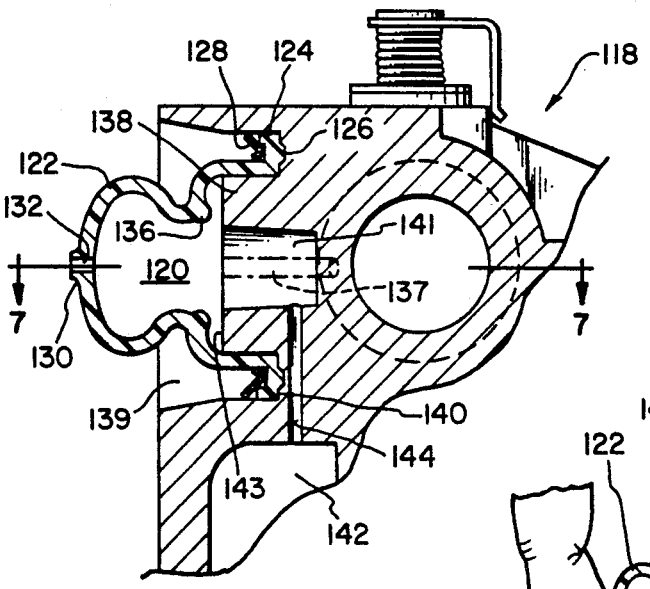
FIG. 6 is a fragmentary vertical sectional view of an alternative embodiment to the carburetor shown in FIGS. 1-5.
Figure 7:
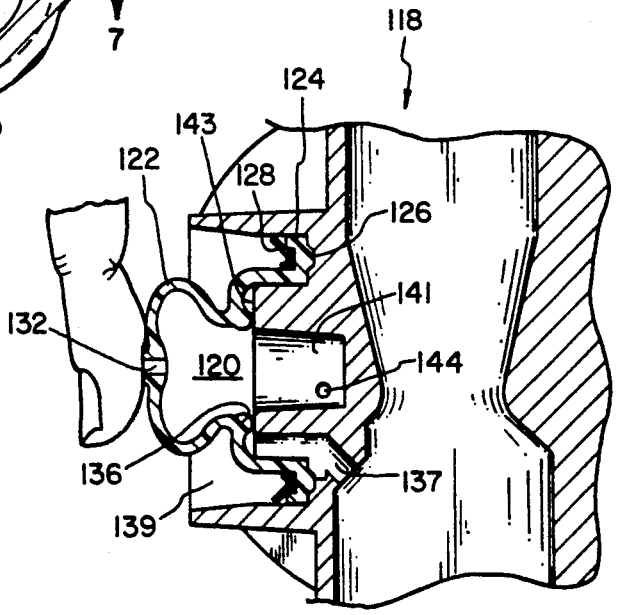
FIG. 7 is a sectional view of the carburetor of FIG. 6, taken along line 7—7 in FIG. 6.

Referring now to FIGS. 6 and 7, a fragmentary view of a carburetor 118 with a priming arrangement is shown, which is an alternative embodiment to the carburetor shown in FIGS. 1-5. Carburetor 118 includes an internal venting arrangement in order to vent excess pressure from headspace 68, similar to carburetor 18 described above. Further details of this venting arrangement may be found in U.S. Pat. No. 4,926,808 issued to Kandler, which disclosure is incorporated herein by reference.

Carburetor 118 also includes a variable volume primer chamber 120. Preferably chamber 120 is formed by sealingly seating a resilient bulb 122 in a pocket 139 in carburetor body 22. Bulb 122 is manually compressible and is preferably made of a resilient rubber-like material. Bulb 122 includes an annular flange 124 having a seating ring 126. Flange 124 and ring 126 are seated in an angular groove (not shown) formed in the base of pocket 139. Flange 124 is retained in the groove by a suitable retainer, such as a retainer ring 128.

Primer bulb 122 includes a nipple 130 which is provided with a vent or aperture 132 to permit air to be admitted into chamber 120. Primer bulb 122 also includes an annular lip 136 disposed along an inner portion of bulb 122. A primer limiter boss 138 is defined in pocket 139 by an annular groove 140 and has a generally cylindrical recessed area 141 disposed therein. As shown in FIG. 7, during a priming operation, bulb 122 is depressed by an operator. When annular lip 136 engages surface 143, lip 136 acts as a check valve and closes off venting passageway 137 from chamber 120. Further details of this priming arrangement may be found in the Kandler '808 patent referred to above.

Primer chamber 120 communicates with cavity 142 of the internal venting passageway through recessed area 141 and priming passageway 144, which may be formed as a drilled and/or cast passage. Since nipple aperture 132 communicates with chamber 120, aperture 132 bleeds off a given portion of the internal vent signal or vacuum in the fuel bowl to provide a lower bowl vacuum. Aperture 132 is sized so that bowl vacuum is bled off only to a certain extent, thereby permitting an overall bowl vacuum to remain. Preferably, aperture 132 has a diameter ranging from 0.070 to 0.080 inch.

It will be appreciated that the foregoing is presented by way of illustration only, and not by way of any limitation, and that various alternatives and modifications may be made to the illustrated embodiment without departing from the spirit and scope of the invention.

What is claimed is:

1. A carburetor for providing a fuel/air mixture to an internal combustion engine, said carburetor comprising:

a carburetor body having a bore formed therein, said bore including an air inlet passage having an air inlet opening defining a fuel/air mixture passage;

a float regulated fuel supply bowl adapted to contain a quantity of liquid fuel and having a headspace above said fuel;

a fuel nozzle for conveying fuel from said fuel supply bowl to said fuel/air mixture passage;

a throttle plate in said fuel/air mixture passage for controlling the amount of fuel/air mixture exiting said fuel/air mixture passage, wherein a vacuum condition exists in said carburetor body upon engine operation;

a choke plate in said air inlet passage for controlling the amount of air flow through said bore;

an internal vent passageway having an open end located in said bore between said choke plate and said air inlet opening, said internal passageway communicating with said headspace so that said fuel supply bowl is vented to said bore, said internal passageway being sized such that upon engine operation, said vacuum condition exists in said headspace; and an external vent passageway in direct communication with said headspace and the atmosphere external of the carburetor, said external vent passageway being sized relative to said internal vent passageway to bleed off a partial portion of said vacuum in said headspace upon engine operation.

2. The carburetor of claim 1, wherein said external passageway extends from said internal vent passageway to the atmosphere.

3. The carburetor of claim 1, wherein said external passageway is a calibrated orifice.

4. The carburetor of claim 3, wherein said orifice size is about 0.062 inch±0.002 inch.

5. A carburetor for providing a fuel/air mixture to an internal combustion engine, said carburetor comprising:

a carburetor body having a bore formed therein, said bore including an air inlet passage having an air inlet opening and a throat defining a fuel/air mixture passage;

a float regulated fuel supply bowl adapted to contain a quantity of liquid fuel and having a headspace above said fuel;

a fuel nozzle for conveying fuel from said fuel supply bowl to said fuel/air mixture passage;

a throttle plate in said fuel/air mixture passage for controlling the amount of fuel/air mixture exiting the fuel/air mixture passage, wherein a vacuum condition exists in said carburetor body upon engine operation;

a choke plate in said air inlet aperture for controlling the amount of air flow through said bore;

an internal vent passageway having an open end located in said bore between said choke plate and said air inlet opening, said internal passageway communicating with said headspace so that the fuel supply bowl is vented to said bore, said internal passageway being sized such that upon engine operation, said vacuum condition exists in said headspace;

a primer bulb defining a variable volume primer chamber; and a priming passageway extending from said chamber directly to said headspace, said bulb having an external vent aperture therein for admitting air into said chamber, said external vent aperture being sized relative to said internal vent passageway to bleed off a partial portion of said vacuum in said headspace upon engine operation.

* * * * *

UNITED STATES PATENT AND TRADEMARK OFFICE

CERTIFICATE OF CORRECTION

PATENT NO. : 5,273,008

DATED : December 28, 1993

INVENTOR(S) : Stephen D. Ditter

It is certified that error appears in the above-identified patent and that said Letters Patent is hereby corrected as shown below:

On the first page of the patent in the title under item [54] change "CARBUETOR" to --CARBURETOR--.

Column 1, line 3, change "CARBUETOR" to --CARBURETOR--.

Signed and Sealed this

Twenty-fourth Day of May, 1994

Bruce Lehman

*Attest:*

BRUCE LEHMAN

*Attesting Officer*

*Commissioner of Patents and Trademarks*